US009085386B2

(12) United States Patent
Hengami

(10) Patent No.: US 9,085,386 B2
(45) Date of Patent: Jul. 21, 2015

(54) EASY DISPENSING BOX WITH TOP SLIDE OPENING

(76) Inventor: David Todjar Hengami, Torrance, CA (US)

( * ) Notice: Subject to any disclaimer, the term of this patent is extended or adjusted under 35 U.S.C. 154(b) by 287 days.

(21) Appl. No.: 12/686,252

(22) Filed: Jan. 12, 2010

(65) Prior Publication Data

US 2011/0168767 A1 Jul. 14, 2011

(51) Int. Cl.

| | |
|---|---|
| ***B65D 5/64*** | (2006.01) |
| ***B65D 5/72*** | (2006.01) |
| ***B65D 5/02*** | (2006.01) |

(52) U.S. Cl.

CPC ..... *B65D 5/723* (2013.01); *B65D 5/0227* (2013.01)

(58) Field of Classification Search

CPC ..... B65D 5/723; B65D 75/5894
USPC ..... 229/129.1, 131.1, 220, 125.12, 210, 229/125; 493/150; 206/540, 536, 468; 220/345.3, 345.2, 345.1

See application file for complete search history.

(56) References Cited

U.S. PATENT DOCUMENTS

| | | | | |
|---|---|---|---|---|
| 958,707 | A * | 5/1910 | Stafford | 229/125.12 |
| 1,951,274 | A | 3/1934 | Denman | |
| 2,330,926 | A | 10/1943 | Rous | |
| 2,342,081 | A * | 2/1944 | Kirkland et al. | 229/220 |
| 2,349,748 | A * | 5/1944 | Otto | 229/220 |
| 2,507,430 | A | 5/1950 | Yancey | |
| 3,033,436 | A | 5/1962 | Peimer | |
| 3,040,953 | A | 6/1962 | Tindall | |
| 3,126,141 | A | 3/1964 | Walter | |
| 3,229,888 | A | 1/1966 | Gillam | |
| 3,819,093 | A | 6/1974 | Forbes et al. | |
| 4,081,128 | A | 3/1978 | O'Neill | |
| 4,197,985 | A | 4/1980 | Austin | |
| 4,609,142 | A | 9/1986 | Adamek | |
| 5,348,219 | A | 9/1994 | Brintazzoli | |
| 5,505,373 | A | 4/1996 | Von Stillfried | |
| 6,116,499 | A | 9/2000 | Todjar-Hengami | |
| 6,273,332 | B1 | 8/2001 | Todjar-Hengami | |
| 6,360,942 | B2 | 3/2002 | Todjar-Hengami | |
| 6,435,402 | B1 | 8/2002 | Hengami | |
| 6,945,449 | B2 | 9/2005 | Hengami | |
| 7,040,528 | B2 | 5/2006 | Hengami | |
| 7,156,286 | B2 | 1/2007 | Hengami | |

(Continued)

FOREIGN PATENT DOCUMENTS

| | | |
|---|---|---|
| WO | WO03082694 | 10/2003 |

OTHER PUBLICATIONS

PCT International Search Report and the Written Opinion of the International Searching Authority.

*Primary Examiner* — Christopher Demeree
(74) *Attorney, Agent, or Firm* — Robert J. Lauson; Lauson & Tarver, L.L.P.

(57) ABSTRACT

A box for easy dispensing of solid pourable product has a slide with a portion fixed, preferably by adhesive, to the top, but otherwise detachable from the box, preferably along a perforation. One of the sides of the box has an opening near the top of the box, covered by the slide. Upon lifting the top of the box and thereby detaching the slide, the opening is uncovered enabling the contents to flow from inside the box. The easy-dispensing box is constructed by starting from a single sheet of blank stock, and folding the sides, preferably into a tube box with sealed ends. Advantageously, the slide and the stops end up inside the box and properly located, and both ends of the box may be sealed.

8 Claims, 8 Drawing Sheets

(56) References Cited

U.S. PATENT DOCUMENTS

| | | | |
|---|---|---|---|
| D551,976 | S | 10/2007 | Hengami |
| 7,337,904 | B2 | 3/2008 | Hengami |
| 7,743,973 | B2 | 6/2010 | Hengami |
| 2008/0128480 | A1 | 6/2008 | Hengami |

* cited by examiner

EASY DISPENSING BOX WITH TOP SLIDE OPENING

BACKGROUND

Clever packaging for solid pourable product, offering improved functionality, appeals to customers. Applicant's specialty boxes with slide openings enable convenient dispensing of contents, and thus provide food manufacturers a competitive advantage. Applicant is the owner of von Stillfried U.S. Pat. No. 5,505,373 for a "Folding Package," and is the named inventor on numerous issued U.S. patents for specialty packaging including U.S. Pat. Nos. 6,116,499, 6,273,332, 6,360,942, 6,435,402, 6,945,449, 7,040,528, 7,156,286, D551,967 and 7,337,904, as well as U.S. Patent Application Publication No. 2008/0128480 for a "Thumb-Actuated Candy Or Mint Box."

Although for a time Applicant licensed the von Stillfried patent for use on Certs® mints boxes, Applicant's specialty boxes have otherwise yet to be widely distributed. The primary reason has been difficulty in manufacturing Applicant's boxes on a mass production scale. Major food or candy manufacturers have high-speed form, fill and seal packaging machines which produce hundreds of boxes of product per minute. These machines take partially-constructed boxes, fold and seal one end, then fill the boxes, and finally fold and seal the opposite end thereby completing the manufacturing.

Early on several of Applicant's box designs with slide openings needed multiple pieces of cardboard to produce, which was disadvantageous. Further, Applicant's boxes have typically required an insertion step or inserting of the slide member in between or adjacent other side panels of the box. This insertion step cannot be easily accomplished by various food or candy manufacturers without significant changes or new high-speed equipment. Therefore given the heavy investment in their hundreds of expensive machines, major manufacturers have been unwilling to adopt Applicant's new box designs, despite the improvements offered in easier dispensing of the pourable food items for customers.

In the "Thumb Activated Candy Or Mint Box" application identified above, Applicant developed a box with a slider from a single sheet of blank stock not requiring the insertion step. The slider moves in a sideways direction perpendicular to the top opening of the box, however, meaning this box differs some from conventional boxes in appearance and operation. Accordingly, Applicant has continued to develop boxes of new and superior functionality which offer improvements over the prior art including in ease of manufacturing and use.

For the foregoing reasons, there remains a need for a box that offers a convenient slide opening for easy dispensing of product, that is easy to manufacture on a mass production scale using conventional high-speed packaging machines, and that is constructed in such a way to avoid any insertion step. There is further a need for a box incorporating a slide opening having the same appearance and handling characteristics as a conventional box, wherein the top flap is lifted to dispense the contents. The improved box should be made from a single sheet of blank stock.

SUMMARY

A box for easy dispensing of solid pourable product includes a top, bottom, at least three sides therebetween and a slide all joined together. The slide is detachable from the sides of the box, and the slide is also fixed to the top of the box. One of the sides has an opening near the top of the box, which is covered by the upper portion of the slide. Lifting the top of the box detaches the upper portion of the slide and uncovers the opening, enabling the solid product to be poured from inside the box.

The box is preferably a tube box, and sealed ends carton with the top and bottom both sealed. The slide is preferably perforated such that it can be easily separated from the box. The slide is preferably fixed to the top of the box by an adhesive applied when constructing the box. The box preferably has two or more major sides and two or more minor sides, and preferably the opening is located in one of the minor sides of the box. The slide is preferably located inside the box, where it preferably bears against a side of the box. The slide preferably includes one or more stop members, such that the slide is contained inside the box even after being detached from remainder of the side of the box. The slide also preferably includes a thumb tab, for easily moving the top (and the slide) separate from the rest of the box, when opening the box. Optionally the box may include a cellophane wrapping, at least over the side opening, which may be of a tamper-evident type.

The easy-dispensing box is constructed by starting with a single sheet of blank stock, having sides all joined together, and having a slide joined to one of the sides, the slide having the upper portion. Constructing the box further includes folding the sides of the blank stock to form a tube box, preferably several thousand at a time which are flattened and delivered together to a high speed production line. Still further, constructing the box includes fixing the slide to the top of the box, and filling the box with a solid pourable product. Advantageously, in constructing the box, the slide and any stop members end up properly located inside the box, avoiding difficult insertion manufacturing steps for the conventional high speed packaging machines used by major food and candy manufacturers.

Dispensing the contents from the box involves the steps of removing any cellophane wrapping if present, and detaching the slide from the remainder of the box, by moving the top of the box that is fixed to the slide. This is advantageous in that the box appears and operates like a conventional box, but rather than the top being opened to create an opening in the top of the box, instead the top is moved to create an opening in the side of the box near the top, an opening that is easy to close and open again as needed. And underneath the slide, preferably the top of the box is sealed closed.

A blank for forming the box is a single sheet of paperboard having at least four sides and a top section, preferably at least two major sides and at least two minor sides. There is a slide joined to one of the sides, the slide detachable from the remainder of the box, preferably by a perforation. The slide also preferably includes one or more stop members, and the side of the paperboard adjacent the slide is preferably cut away, to avoid interference with detachment of the slide. There is an opening in one of the sides, though which the contents of the box may be poured when the opening is not blocked by the slide.

DESCRIPTION

Figure 1:
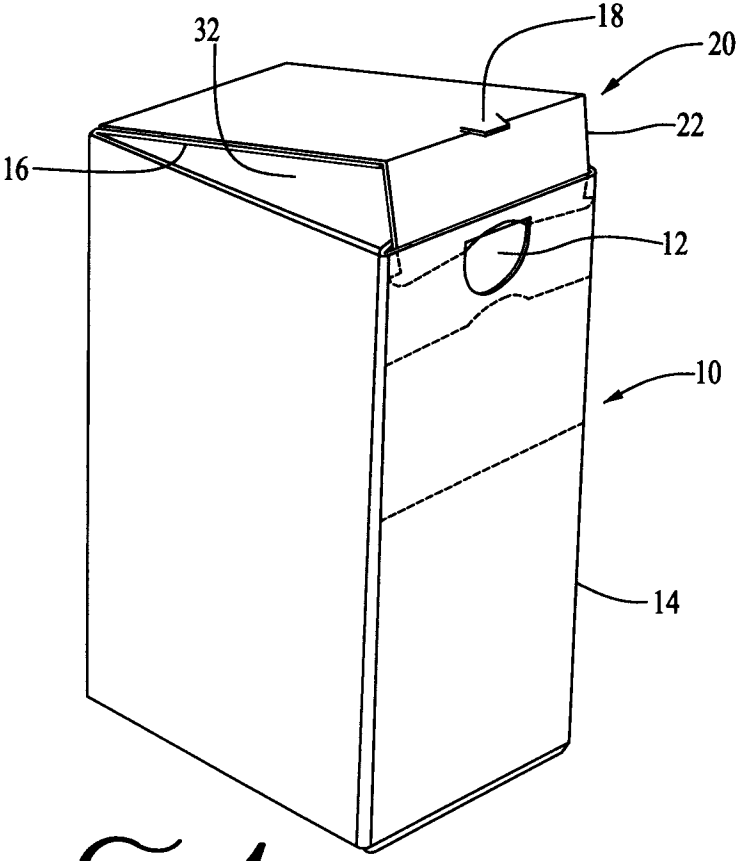
FIG. 1 is a perspective view of a preferred embodiment, shown with the slide open, to enable convenient dispensing of the product through a minor side of the box.
Figure 2:
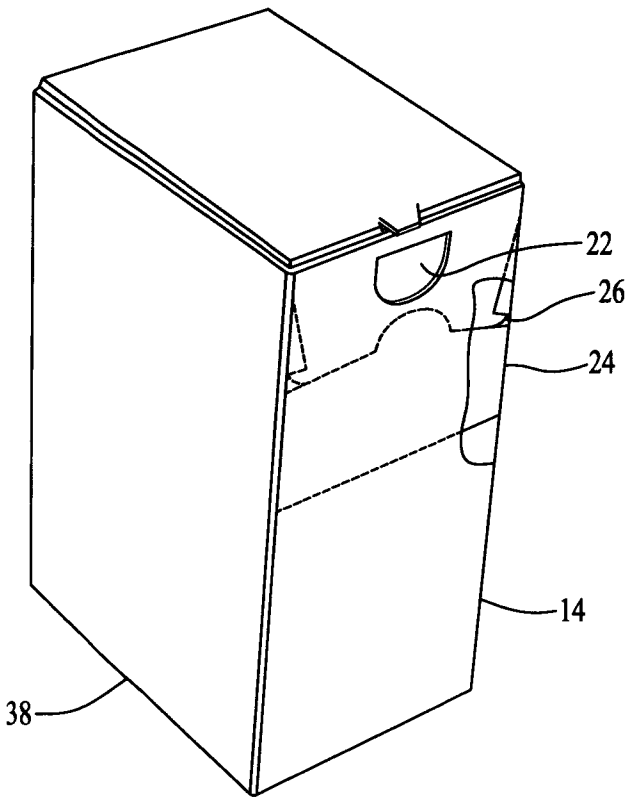
FIG. 2 is a perspective view of the same box with the slide in a closed position.
Figure 4:
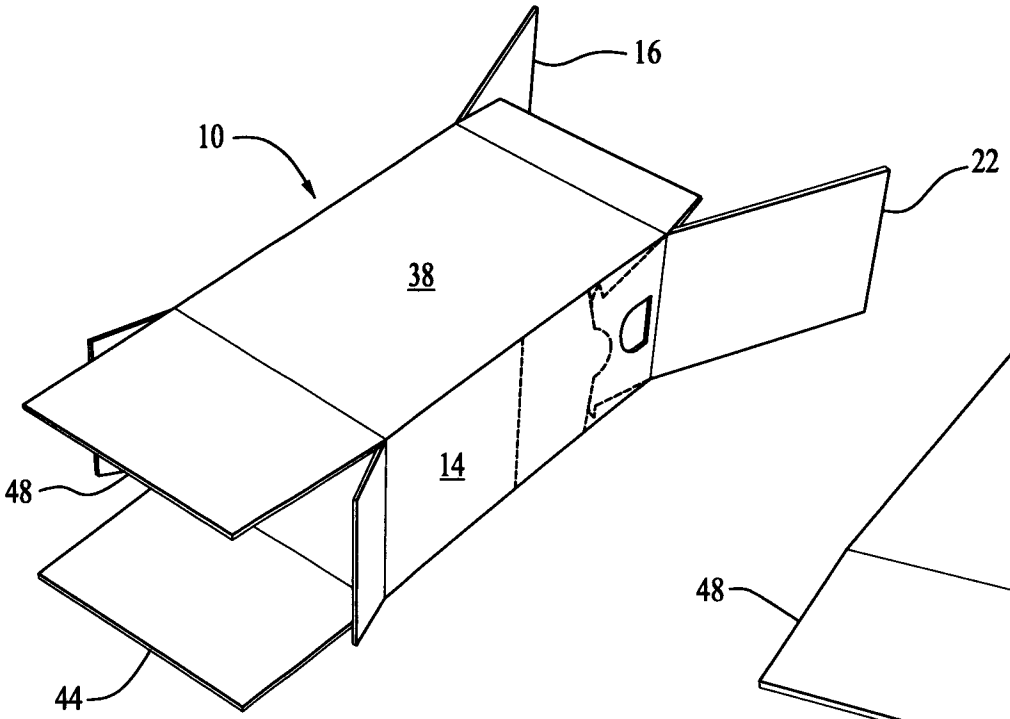
FIG. 4 is a perspective view showing the constructed tube box, with the open top and bottom.

Referring to FIG. 1, the preferred embodiment easy-dispensing box is depicted. The opening 12 is in a minor side 14 of the box. In FIG. 1, the top 16 of the box has been lifted, preferably by the thumb tab 18, such that the slide 20, namely the upper portion 22, has been moved upward so that it no longer covers the opening 12. The box 10 can be inverted, and the contents (not shown) poured through the opening 12. A lower portion 24 of the slide 20 is located inside the box 10 behind the minor side or panel 14, and thus is shown in phantom. Also note the upper portion 22 of the slide 20 has a pair of stop members 26, 28, which catch on the top flaps 32, 24 (see FIG. 4), and thus prevent the slide 20 from being separated from the box 10. FIG. 2 illustrates the slide 20 in a closed position, with the upper portion 22 adjoining the lower portion 24 and blocking the opening 12 in the side 14, such that the contents may no longer be poured out of the box 10.

Figure 6:
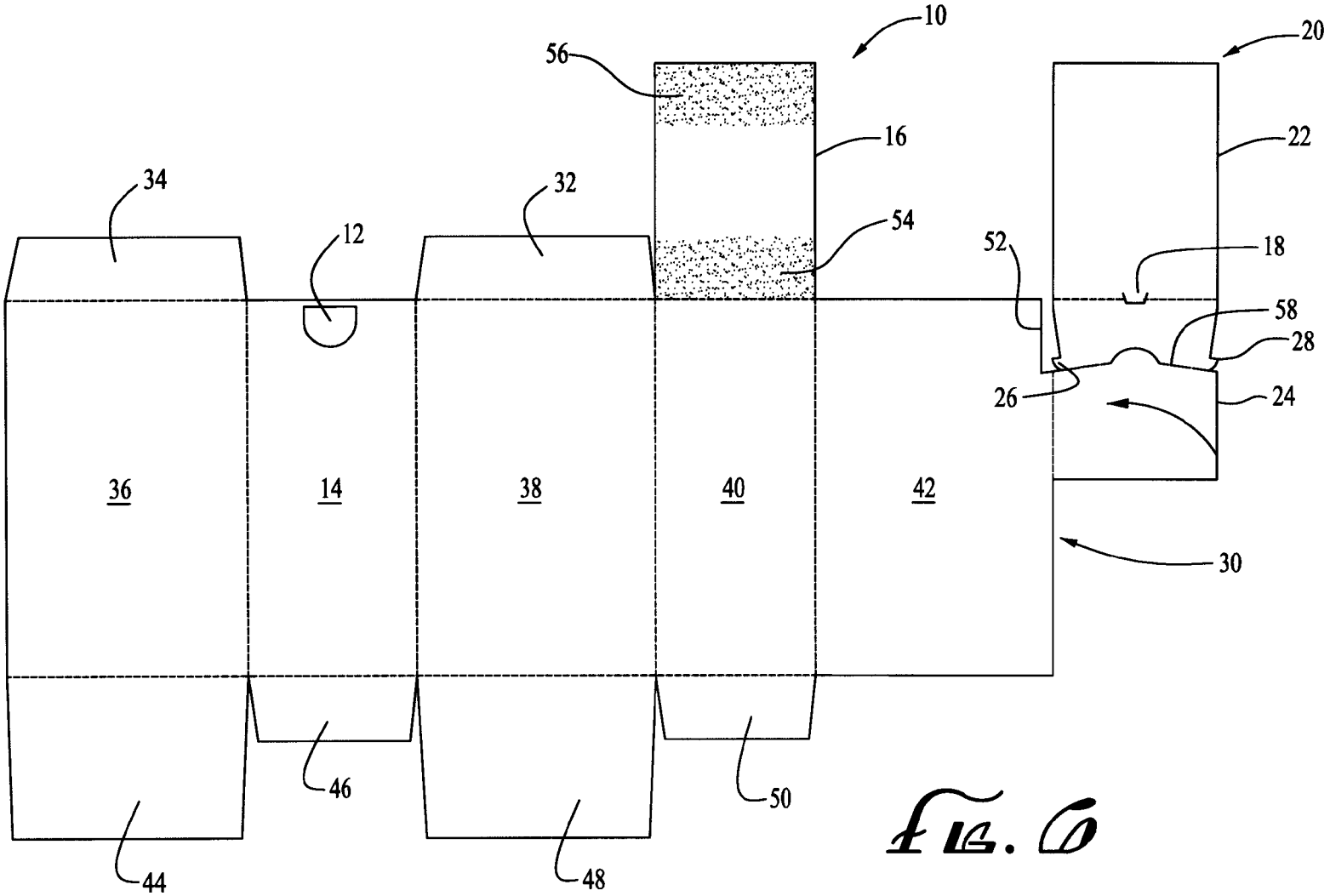
FIG. 6 is a flat pattern view of the blank stock from which the same box is made.

FIGS. 3-6 show initial construction of the tube box 10 from a blank stock 30 paperboard, cardboard or the like, and the folding and gluing operations at the manufacturer's joint, and flattening for delivery to the packaging line. Preferably several thousand tube boxes would be partially constructed and flattened (FIG. 5), for delivery to the high speed production line for filling and completion of the box 10. Referring to FIG. 6, the blank stock 30 is a single sheet cut into the flat pattern shown, with major sides or panels 36, 38 and 42 (the manufacturer's joint), and minor sides 14, 40. Minor side 14 includes the opening 12, which could take on a variety of sizes and shapes depending upon the contents to be poured from the box 10. The top of the box includes the top side 16, which preferably has a pair of glue areas 54, 56, to which the upper portion 22 of the slide 20 is adhered to, in the process of folding and constructing the box. Further there are optional "dust" flaps 32, 34. The paperboard or cardboard 30 is "nicked" or perforated 58 between the upper 22 and lower 24 portions of the slide 20 for easy separation. The bottom of the box 10 also includes sides 44, 48 and flaps 46, 50, which are preferably glued together once the contents are added to the box.

Figure 3:
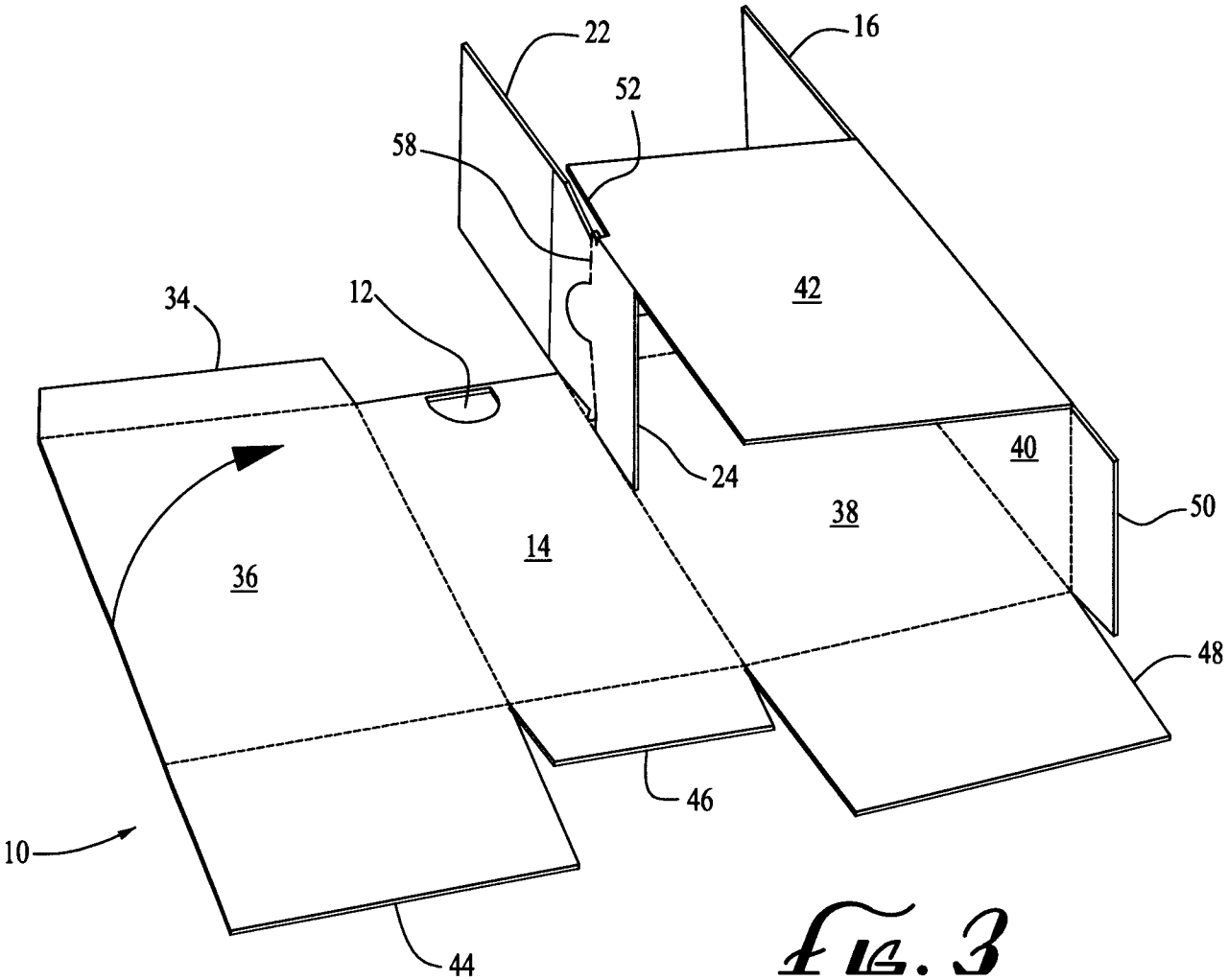
FIG. 3 is a perspective view showing folding of the same box.
Figure 5:
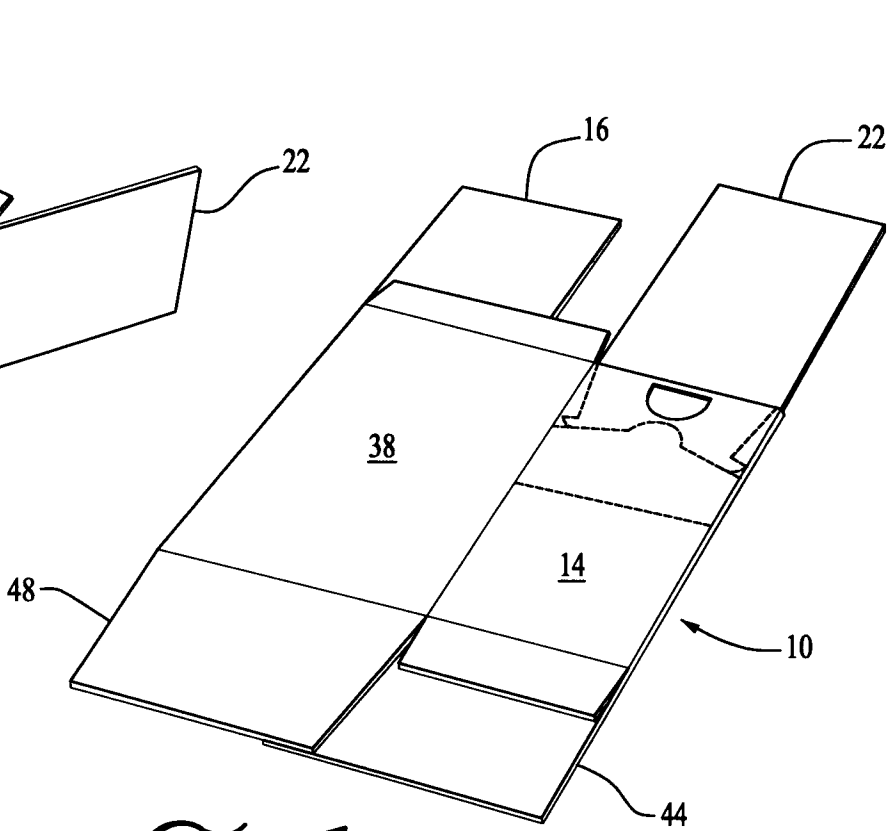
FIG. 5 is a perspective view of the tube box in a flattened position.

Now referring to FIG. 3, the initial folding of the box is shown. As indicated by the arrow in FIG. 4, a first step may be folding the slide 20 to be at a right angle 90 degrees to the adjoining major side 42 (manufacturer's joint). Then, continued 90 degree folds in the same direction, as indicated by FIG. 3 and the arrow shown, forming the tube box 10 of FIG. 2. Glue would also typically be applied to the manufacturer's joint 42 in initial construction of the box into the flattened configuration shown in FIG. 5. Usually, the top part of the box 10 would be constructed and the bottom left open, the contents added, and the bottom flaps 46, 50 and sides 44, 48 closed and sealed, by food manufacturer's high speed fold, form and seal packaging machines. Those standard operations are shown in FIGS. 2-5 of Applicant's pending application for "Thumb-Actuated Candy Or Mint Box," U.S. publication no. 2008/0128480. Optionally, the bottom of the box 10 could be sealed first, and the food product added through the top and then the top sealed.

Figure 7:
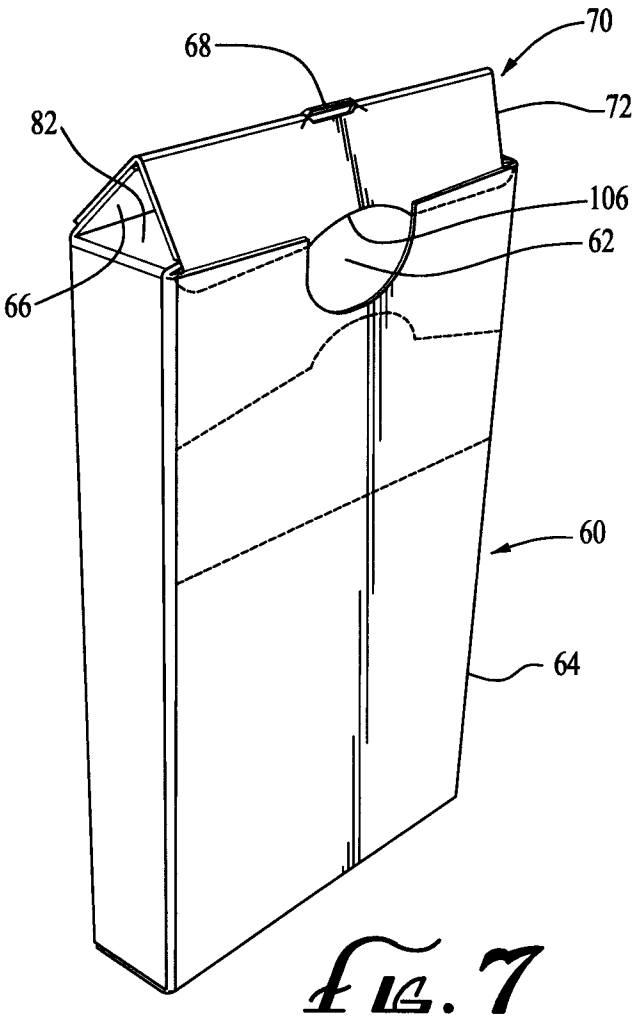
FIG. 7 is a perspective view of an alternate embodiment where the slide opening is on a major side of the box.
Figure 8:
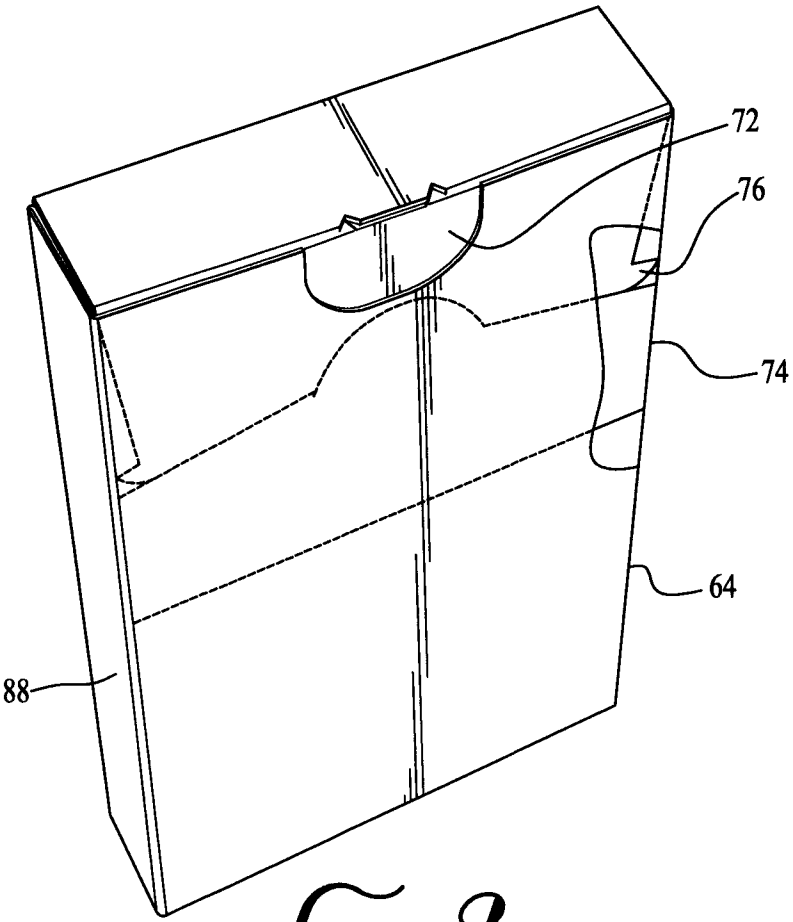
FIG. 8 is a perspective view of the same box with the slide closed.

An alternate embodiment box 60 is shown in FIGS. 7-12, in which the opening is a cutout 62 in a major side 64 of the box 60, rather than in the minor side 14 of the box 10 described above. The configuration and operation of this box 60 is similar to the box 10 previously disclosed, although this embodiment 60 has the advantage of requiring less of the paperboard or cardboard 80 material. FIG. 7 shows the box 60 in an open position, the upper portion 72 of the slide 70 (combined with the top side 66 of the box 60) having been separated from the lower portion 74 of the slide 70 and moved upward, such that it no longer blocks the cutout opening 62 in major side 64. FIG. 8 shows the box 60 back in the closed position.

Figures 9, 10:
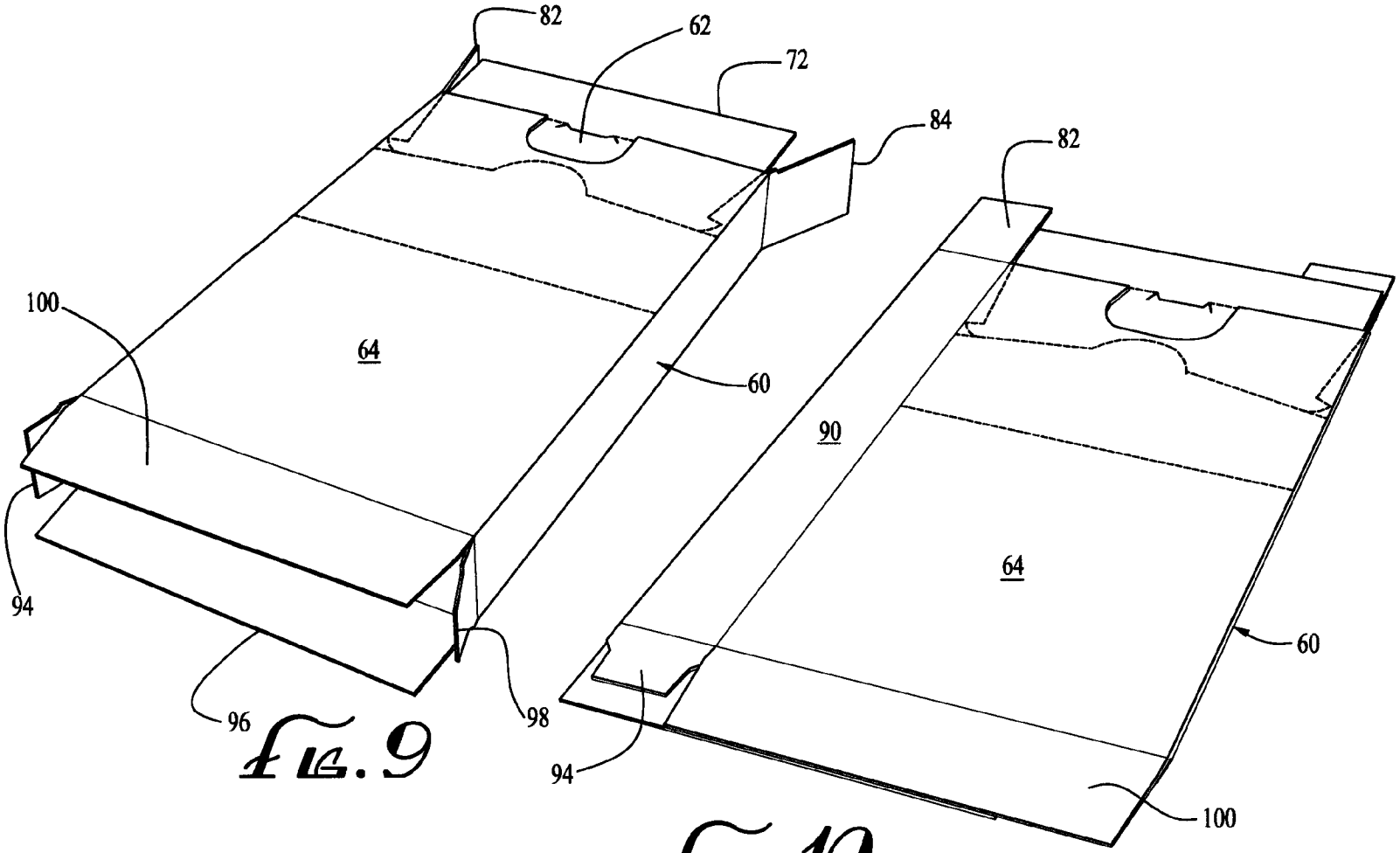
FIG. 9 is a view of the alternate embodiment during construction with the sides folded together forming a tube box.
FIG. 10 is a perspective view of the alternate embodiment tube box in the flattened position.
Figure 11:
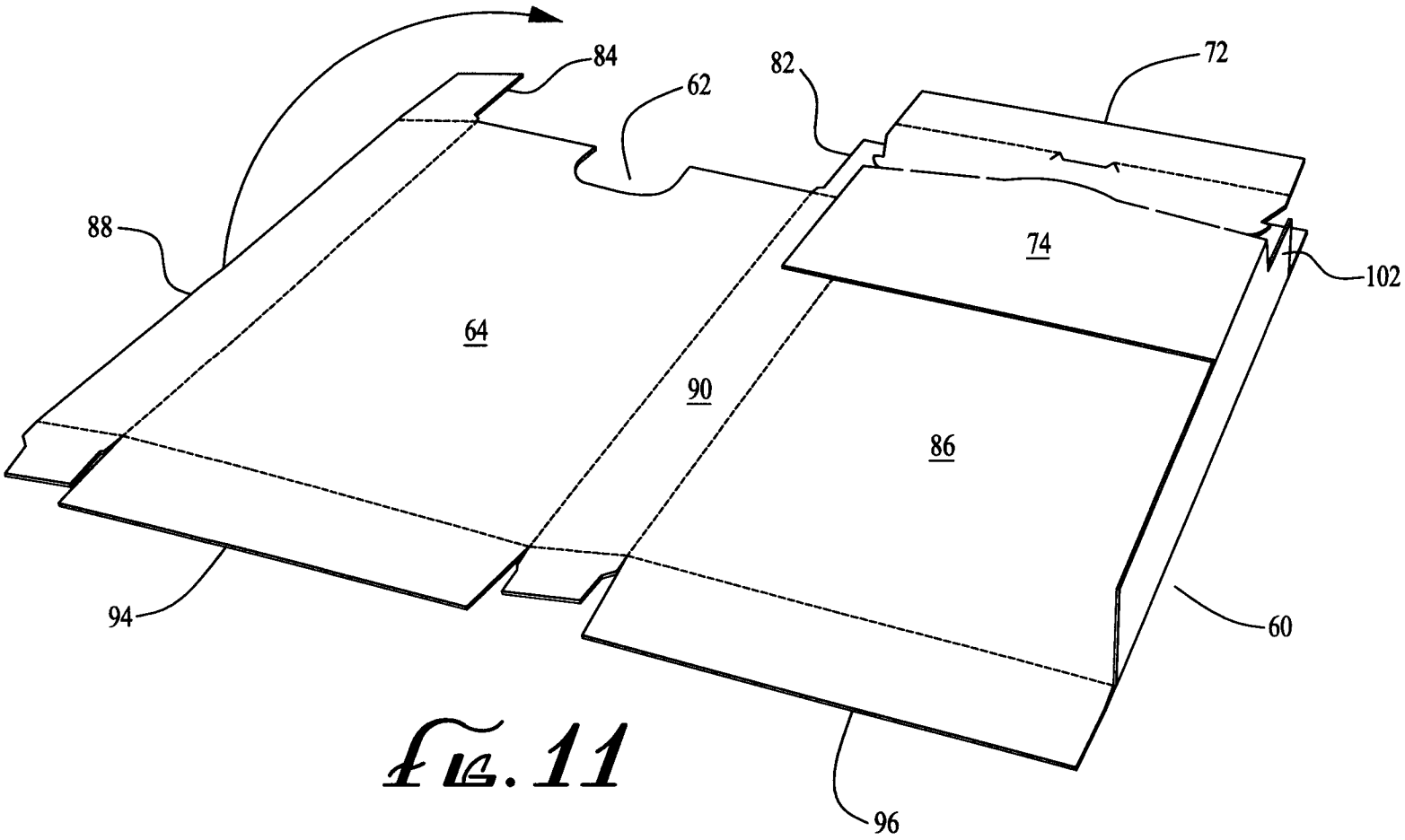
FIG. 11 is a perspective view showing the folding operation of this box.
Figure 12:
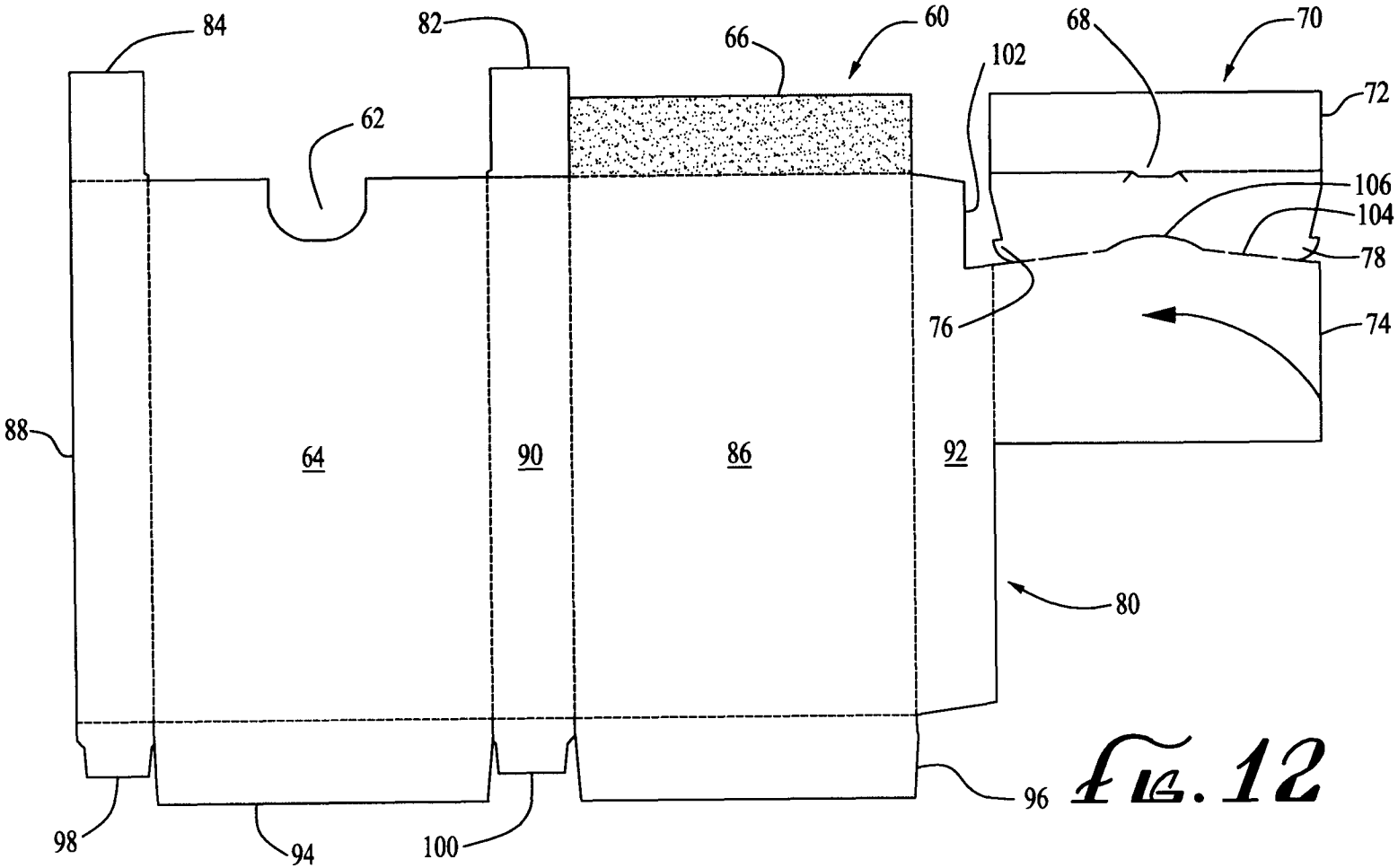
FIG. 12 is a flat pattern view of the alternate embodiment box before the folding operations.

FIG. 12 illustrates the flat pattern blank 80, including major sides 64, 86, minor sides 88, 90, 92 (manufacturer's joint), top side 66, top flaps 82, 84, bottom sides 94, 96 and bottom flaps 98, 100. Additionally, part of the blank flat pattern 80 is slide 70, including upper portion 72, lower portion 74, and the perforated line 104 between the two. Note the curved portion 106 of the upper portion 72 of the slide 70 defines the upper edge of the opening 62 for this embodiment box 60. FIGS. 9-12 show the construction of the box 60, with the arrow in FIG. 12 indicating folding of the slide 70 ninety degrees towards the minor side 92. Subsequent folding steps are indicated by FIGS. 9-11 to form the tube box 60, which is then preferably glued at the manufacturer's joint 92 and flattened (FIG. 10) for delivery to the high speed production line.

While particular forms of the invention have been illustrated and described, it will also be apparent to those skilled in the art that various modifications can be made without departing from the spirit and scope of the invention. Accordingly, it is not intended that the invention be limited except by the appended claims.

What is claimed is:

1. A package for solid pourable product comprising:

a blank stock defining a one-piece pattern having a plurality of flap portions foldably extending from a plurality of longitudinally extending panels, the flap portions of the pattern respectively defining top and bottom flaps and a slide, each of the flap portions of the pattern terminating at free edges, with opposing free edges of adjacent flaps being separated by a taper formed along at least one of said opposing free edges;

the slide having an upper portion detachable from a lower portion, the upper portion of the slide being connected to the pattern solely through the lower portion;

the lower portion fixed to one of the panels of the pattern;

a first part of the upper portion defining a first top flap for a box;

one of the panels having an opening proximate the first top flap for a box;

the opening covered by a second part the upper portion;

a second top flap for a box defined by a flap portion of the pattern adhesively connected to the upper portion;

a fold line connecting the second top flap to a panel opposite the opening, and serving as the line of axis around which the second top flap for a box and upper portion pivot; and wherein a box is constructed from the blank stock such that upon detaching the upper portion from the lower portion and pivotally lifting the upper portion, the opening is uncovered;

whereby the solid pourable product may be dispensed through the opening.

2. The package of claim 1 wherein the box is a tube box.

3. The package of claim 1 wherein the slide is perforated for easy detachment.

4. The package of claim 1 wherein the top and bottom flaps of the box are sealed closed by an adhesive.

5. The package of claim 1 wherein the box has two or more major panels and two or more minor panels, and the opening is located in one of the minor panels of the box.

6. The package of claim 1 wherein the slide further comprises one or more stop members, to contain the at least a portion of the slide inside the box.

7. The package of claim 1 wherein the slide further comprises a thumb tab.

8. The package of claim 1 wherein the box is adapted to lay flat upon opening the top flaps and the bottom flaps.

* * * * *